United States Patent [19]

Hall et al.

[11] 4,178,399

[45] Dec. 11, 1979

[54] FLAME RETARDANT AND PROCESS

[75] Inventors: Seymour G. Hall; Edward D. Mason, both of Greensboro, N.C.

[73] Assignee: Chemonic Industries, Inc., Greensboro, N.C.

[21] Appl. No.: 877,578

[22] Filed: Feb. 14, 1978

[51] Int. Cl.[2] ..... B05D 3/02; C07F 9/02

[52] U.S. Cl. ..... 427/381; 260/942; 260/968; 427/389; 427/390 D; 427/394

[58] Field of Search ..... 260/942, 968; 427/390 D, 381, 394, 389; 8/116 P

[56] References Cited

U.S. PATENT DOCUMENTS

| | | | |
|---|---|---|---|
| 3,877,974 | 4/1975 | Mischutin | 427/390 X |
| 3,897,584 | 7/1975 | Swidler et al. | 427/390 X |
| 3,974,310 | 8/1976 | Mischutin | 427/390 D |
| 4,080,480 | 3/1978 | Reinhardt et al. | 427/390 X |

*Primary Examiner*—Michael R. Lusignan

[57] ABSTRACT

This invention consists of a novel flame retardant, its method of manufacture and its application to textile fabrics in order to render fabrics flame retardant. The flame retardant compound produced can be applied by padding it onto the fabric and it provides a durable flame retardant which will not support combustion.

3 Claims, No Drawings

FLAME RETARDANT AND PROCESS

BACKGROUND AND OBJECTIVES OF THE INVENTION

Various brominated compounds have been used in the past to render textile fabrics flame retardant such as that disclosed in U.S. Pat. application Ser. No. 733,705, abandoned. However, brominated compounds used in the past have been found to have relatively short durability when used on nylon and other synthetic fabrics and such fabrics or fibers when treated lose their flame retardancy after several launderings or dry cleanings. Therefore, it has been highly desirable to provide a compound which will be highly durable and remain effective after repeated launderings or dry cleanings and one that is economically practical for yarn and fabric processors.

With this background in mind the present invention was conceived and one of its objectives is to provide a durable flame retardant for fabrics and resins.

It is another objective of the present invention to provide a procedure by which the durable brominated flame retardants can be easily manufactured.

It is still another objective of the present invention to provide a relatively inexpensive flame retardant for textile fabrics and resins.

It is yet another objective of the present invention to provide a method for producing flame retardant fabrics which can be cut and sewn into garments.

It is still another objective of this invention to provide a method for applying the flame retardant in a manner to render it permanently affixed.

SUMMARY OF THE INVENTION

The flame retardants of this invention are preferably prepared as follows:

Benzene phosphinic acid is reacted with ethylene glycol in a stainless steel reactor to form an aromatic alcohol. This aromatic alcohol is then reacted with tetrabromophthalic anhydride under suitable conditions to form the resulting flame retardant ester. This ester can then be applied to textile fabrics as further explained below to provide permanent flame retardant characteristics in fabrics. As used herein, yarns, fibers, woven or non-woven fabrics, knit goods and other textile structures can be rendered flame retardant with sufficient modifications incorporated into the fabric processing equipment as is known by those skilled in the art. Also, in addition to utilizing the compounds of this invention with textile structures, the flame retardants described herein may be used with various resins as are known in the plastics industry.

DETAILED DESCRIPTION OF THE INVENTION

The preferred preparation of one example of the flame retardants herein may be carried out as follows:

A suitable glass lined mixing tank equipped with heating equipment is charged with 25.8 pounds of benzene phosphinic acid and under slow agitation, 17.2 pounds of ethylene glycol are added while the mixture is slowly raised to 100° C. The solution at first appears hazy but after approximately one hour the solution becomes clear and the resulting aromatic alcohol is the glycol derivative of benzene phosphinic acid as illustrated by the following equation:

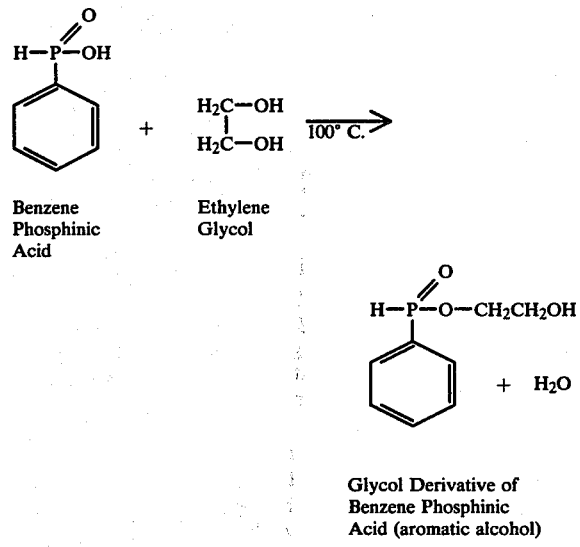

The temperature in the mixing tank containing the aromatic alcohol as shown above is allowed to cool to 70° C. and fourteen (14) pounds of diethanolamine (99%) are slowly added while the temperature is kept under 90° C. After all the diethanolamine has been added, forty three (43) pounds of tetrabromophtalic anhydride are added and the temperature is maintained at approximately 140° C. until the reaction is complete. Thirty minutes has been found to provide sufficient time for the reaction to complete itself at 140° C. as shown in the following equation:

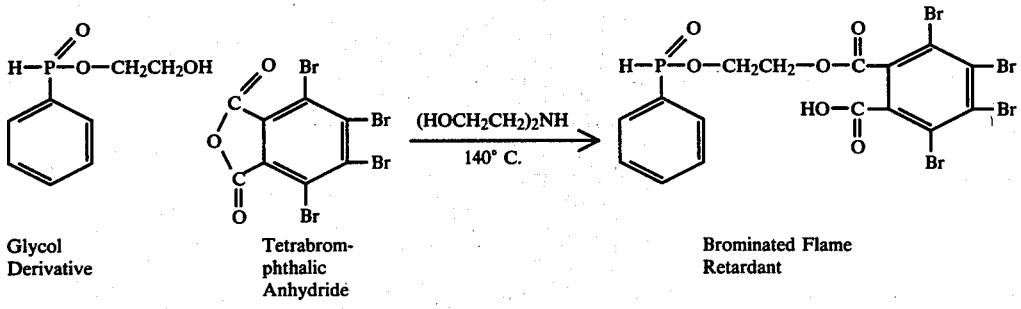

The brominated flame retardant produced is a clear viscous liquid with only slight water solubility.

Other polyhydroxy compounds can be used in place of ethylene glycol to form suitable derivatives for reaction with the tetrabromophthalic anhydride to form flame retardants as shown in the equation below:

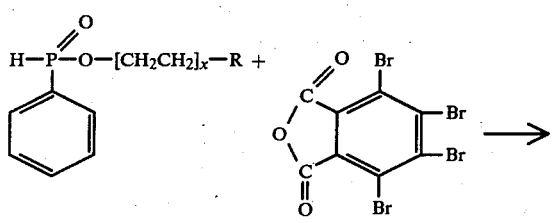

Polyhydroxy alcohol Derivative

Tetrabromophthalic Anhydride

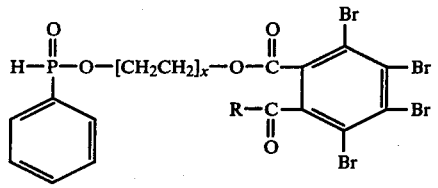

FLAME RETARDANT
R ' $NH_2$;—OH;
or —H

Examples of other reactive compounds which may be used in place of ethylene glycol are as follows: propylene glycol, polyethylene glycol, ethylene oxide, propylene oxide, compounds of general formula ROH where R is any alkyl or substituted alkyl group. The group may be primary, secondary or tertiary; it may be an open chain or cyclic and it may contain a double bond, a halogenated or aromatic ring.

The brominated flame retardants produced as shown above are only slightly soluble or insoluble in water but can be made more soluble by adding for example ammonium hydroxide ($NH_4OH$) in the amount of 3–7% of the flame retardant's weight directly to the flame retardant. Also the ammonium hydroxide can be added instead to the finishing bath during fabric processing, if desired. Other water soluble basic compounds may be used to raise the pH of the flame retardant solution such as triethanolamine, diethanolamine, sodium hydroxide and others in place of the ammonium hydroxide as may be determined by those skilled in the chemical arts.

To fire retard polyester or other selected synthetic fabric fibers such as nylon, acetate or even natural fibers such as wool, a typical padding assembly is used having upper and lower roller members with tension adjustments to regulate the amount of flame retardant absorbed by the fabric or wet "pick-up". It has been found that from 2–8% net dry weight increase of the fabric is sufficient to provide suitable flame retardancy. That is, for each 100 pounds of fabric, approximately 2–8 pounds of dry flame retardants are picked up by the fabric during padding.

A flame retardant working solution for use with conventional padding equipment as described above can be made by combining 5–8 pounds of flame retardant having 2–7% by weight of ammonium hydroxide with 92–95 pounds of water. The mixture is then stirred and a virtually colorless solution is formed which has a suitable viscosity and which can be used with the padding equipment to treat the desired fabric which may be for example, polyester.

After wet pick-up the fabric is dryed and heated to approximately 380–410° F. for 30–60 seconds in order to fix the flame retardant and the short time prevents damage to the fabric, though other temperatures and times may be found to be suitable depending upon the particular fabric employed and the heating equipment used. The polyester fabric thus processed and heated allows the flame retardant to migrate into its fibers and the high temperature also vaporizes the water and ammonium hydroxide, thus leaving the fabric with a slightly soluble or water insoluble flame retardant affixed thereto. The very slight water solubility of the flame retardant after affixation on the fabric has not been found to adversely affect the flame retardant characteristics of the fabric and even after many washings the flame retardant remains durable and effective.

It has been found that fabrics thus treated pass the flammability standards as set forth in Federal Flammability Test Nos. DOC-FF 3-71 and FF 5-74, and maintain a soft hand with good drapability. Besides the flame retardant properties impacted to textile fabrics, the compound as illustrated herein can also be used with resins such as acrylics, polyesters, polyvinyl chlorides, polyvinylacetates and others.

Illustration of the application of the flame retardant of the present invention are demonstrated as follows:

EXAMPLE 1

| Fabric | Finish Bath |
|---|---|
| 100% Polyester Woven Cloth; 2–4 ounces per square yard | 4% flame retardant<br>1.5% aqueous ammonia<br>94.5% water |

PROCEDURE:

The fabric is padded with the finish bath solution to obtain approximately a 2% dry flame retardant weight on the fabric. The fabric is dried at 220° F. and then cured at 380°–410° F. for approximately 30–60 seconds. The fabric is then after washed with a 3–5% soda ash solution after which it is rinsed in plain water and allowed to dry at room temperature, though warm air drying may also be used if desired.

The fabric thus treated has a durable flame retardant affixed and will provide effective results after many launderings or dry cleanings.

EXAMPLE 2

| Fabric | Finish Bath |
|---|---|
| 100% Polyester Knit Fabric 4–6 ounces per square yard | 6% flame retardant<br>2% aqueous ammonia<br>92% water |

PROCEDURE:

The fabric is padded with the finish bath solution whereby a 4% dry flame retardant weight is picked up in the padding process. The fabric is dried at 220° F. and then cured at 380°–410° F. for approximately 30–60 seconds. The after wash is optional.

EXAMPLE 3

| Fabric | Finish Bath |
|---|---|
| 85% Wool, 15% nylon; 16 ounces per square yard | 10.0% flame retardant<br>3.0% aqueous ammonia |

-continued

| Fabric | Finish Bath |
|---|---|
| | 87% water |

PROCEDURE:

The fabric is padded with the finish bath solution whereby a 6–8% dry flame retardant weight is picked up in the padding process. The fabric is then dried in a continuous belt type oven at 230° F. The after wash is optional.

EXAMPLE 4

| Fabric | Finish Bath |
|---|---|
| 100% Polypropylene<br>3 ounces per square yard | 4.0% flame retardant<br>1.0% aqueous ammonia<br>1.0% melamine resin<br>94% water |

We claim:

1. The process of flame retarding non-cellulosic fabrics comprising the steps of: raising the pH of a flame retardant containing the chemical compound:

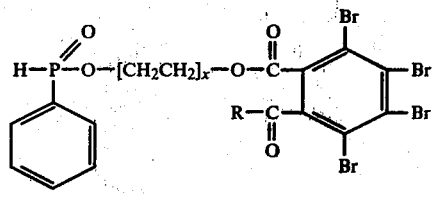

where:

x=1-250, R is selected from the group: —H, —OH, —$NH_3$ or —COOH by adding a water soluble basic compound to thereby increase the water solubility of said flame retardant, padding the fabric with said basic flame retardant solution, absorbing 2–10% dry flame retardant, removing the fabric from the flame retardant solution and fixing said flame retardant to the fabric.

2. The process of flame retarding fabrics as claimed in claim 1 wherein raising the pH comprises adding ammonium hydroxide to the flame retardant.

3. The process of flame retarding fabrics as claimed in claim 1, wherein fixing said flame retardant to the fabric comprises raising the temperature of the fabric to 380°–410° F.

* * * * *